United States Patent [19]

Astbury

[11] 4,443,053

[45] Apr. 17, 1984

[54] ELECTRICAL CONTACT

[75] Inventor: Arthur A. Astbury, Andover, Mass.

[73] Assignee: Altron Incorporated, Wilmington, Mass.

[21] Appl. No.: 405,550

[22] Filed: Aug. 5, 1982

[51] Int. Cl.[3] ..... H01R 13/42

[52] U.S. Cl. ..... 339/221 R

[58] Field of Search ..... 339/220 R, 221 R, 221 M

[56] References Cited

U.S. PATENT DOCUMENTS 4,066,326 1/1978 Lovendusky ..... 339/221 M

*Primary Examiner*—Joseph H. McGlynn

*Attorney, Agent, or Firm*—Charles Hieken

[57] ABSTRACT

A compliant pin has an intermediate portion formed with end sections relatively slidable with a central section. The end sections have outside edges with a small curved portion separated from a longer curved portion further from the central section by a straight portion, the radius of curvature being of the order of the radius of a plated-through hole in which the intermediate portion is to be seated. The central and end sections are always in overlapping relationship along inside edges for a length less than half the length of each inside edge.

6 Claims, 3 Drawing Figures

*Fig.1*
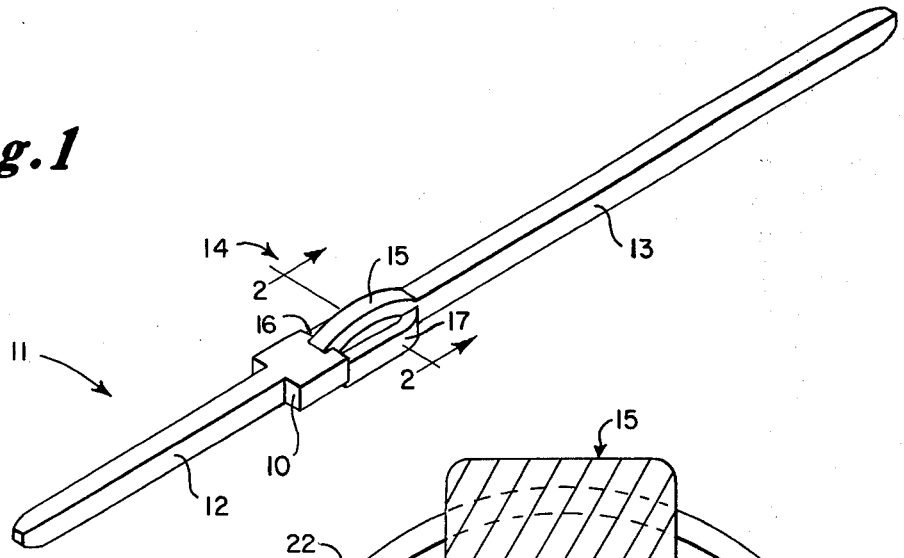
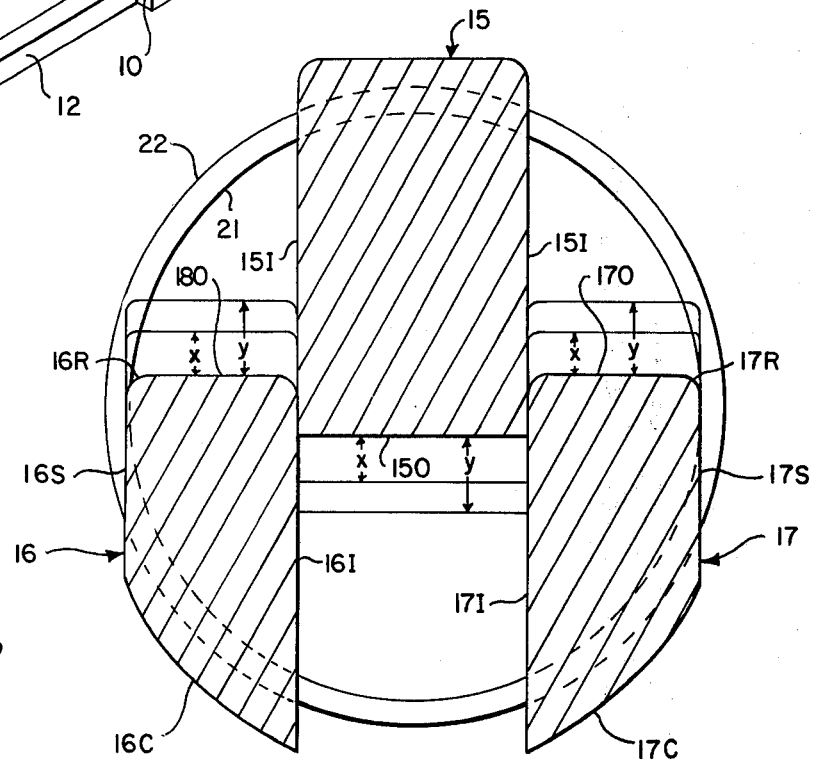
*Fig.2*
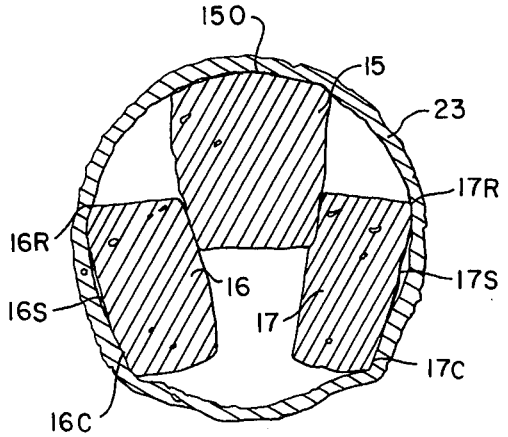
*Fig.3*

ELECTRICAL CONTACT

The present invention relates in general to contacting and more particularly concerns novel apparatus and techniques for contacting a plated-through hole in a printed circuit board with a compliant pin that changes shape to fit the hole while being installed to provide mechanical and electrical contact along a relatively large area with relatively litle hole distortion and undesired fractures.

An established prior art contacting approach used a square pin for a press fit interference in a round printed circuit plated-through hole. This installation produced significant hole distortion and potential damage. A number of other approaches use compliant pins that change shape to fit the hole while being installed to cause less hole distortion and fractures in the copper-plated hole. These prior art patents include a two-section sliding pin such as disclosed in U.S. Pat. No. 4,186,982, a three-section pin disclosed in U.S. Pat. No. 4,066,326, a pin of dog-bone-shaped cross section and a pin of C-shaped cross section.

During a search of the prior art in subclasses 17 C, 220 and 221 of class 339, the following U.S. Pat. Nos. were uncovered: 2,914,745, 3,156,517, 3,545,080, 3,566,343, 3,778,755, 3,846,741, 4,057,315, 4,066,326, 4,186,982, 4,191,440, 4,223,970, 4,274,699.

It is an important object of the invention to provide an improved three-section compliant pin.

According to the invention, there is compliant pin means having a central section relatively slidable with respect to end sections along a path parallel to the straight sides of each section adjacent to a mating straight side with the end sections formed with curved outside portions for mating engagement with the curved surface of the plated-through hole in a circuit board in which it is inserted. Each end section is always in overlapping relationship with the central section over a length (in cross section) of each section that is less than half the length of each section so that when the pin is inserted in a plated-through hole, the end sections rotate about a contacting corner of the central section. The rotation of the end sections about the inner corners of the central section creates a wedging or locking action which prevents the sections from sliding further together and thus insures that the pin remains in intimate contact with the hole.

Numerous other features, objects and advantages of the invention will become apparent from the following specification when read in connection with the accompanying drawing in which:

FIG. 1 is a perspective view of a pin according to the invention;

FIG. 2 is a view through section 2—2 of FIG. 1 superimposed over two circles representing maximum and minimum hole sizes for suitable installation of the pin; and FIG. 3 is a reproduction of a microphotograph of an actual embodiment of the invention seated in a plated-through hole illustrating the exceptionally good electrical and mechanical contact with the inside surface of the plated-through hole with the pin according to the invention.

With reference now to the drawing and more particularly FIG. 1 thereof, there is shown a compliant pin 11 according to the invention having a lower end portion 13, an upper end portion 12 for establishing contact with external circuitry, a push shoulder 10 for allowing an insertion tool to force the pin into a plated-through hole and an intermediate three-section portion 14 constructed according to the invention with a central section 15 relatively slidable against end sections 16 and 17 when the pin is press fit into a plated-through hole in a printed circuit board, as best seen in FIG. 2.

Referring to FIG. 2, there is shown a sectional view through section 2—2 of FIG. 1 superimposed on circles 21 and 22 representing minimum and maximum hole sizes for installing the pin 11. The distances x and y represent the relative displacement between each of end sections 16 and 17 and central section 15 when pin 11 is installed in the larger hole of diameter corresponding to that of circle 22 and a smaller hole of diameter corresponding to that of circle 21, respectively. The inside edges 15I, 16I and 17I are straight as shown and sections 16 and 17 are always in overlapping relationship with central section 15 along a common inside edge length that is less than half the inside edge length of each section. The outside sides of end sections 16 and 17 include a straight portion 16S and 17S, respectively, a relatively long curved portion 16C and 17C, respectively, and a shorter rounded portion 16R and 17R, respectively. The radius of curvature of each of these curved and rounded portions is typically slightly greater than half the width of the three sections, this width typically corresponding to the diameter of circle 21, typically 0.040 inches with the radius of curvature typically 0.021 inches. The uncompressed overall length of the three sections 15, 16 and 17 is typically slightly greater than the diameter of larger circle 22 and typically 0.046 inches. The outside edges 150, 160 and 170 of sections 15, 16 and 17, respectively, are typically straight as shown. The width of central section 15 is typically slightly less than the radius of smaller circle 21 and typically 0.016 inches and its length, and that of each of end sections 16 and 17, is slightly larger than the radius of the larger circle and typically 0.025 inches. The width across central section 15 is typically 0.016–0.017″ and slightly greater than that across end sections 16 and 17 which typically, slightly greater than the diameter of smaller circle 21 so that the width of each end section is typically 0.014–0.015 inches while the length of each is slightly greater than the radius of the larger circle 21 and typically 0.025 inches. The total width of the three sections is typically 0.046 inches. A typical axial length for intermediate three-section portion 14 is 0.110″, that for upper end portion 12 0.0318–0.500″, that for lower end portion 13 0.550–0.750″ and that for push shoulder 10 0.030″. A suitable material is copper alloy, 725.

Referring to FIG. 3, there is shown a reproduction of a microphotograph of an actual section through intermediate portion 14 of pin 11 actually mounted in a plated-through hole 23 showing how the outside edges 16R, 16S, 16C, 17R, 17S, and 17C snugly engage the inside surface of plated-through hole 23 as they rotate about corners 15C of central section 15 while the outside edge 150 of central section 15 also snugly engages the inside surface of hole 23.

The invention thus has a number of advantages. It is relatively easy and inexpensive to fabricate. It establishes good electrical and mechanical contact with a plated-through hole in a printed circuit board over a relatively wide range of hole tolerances without soldering and without severely distorting or fracturing the plated-through hole so that a pin may be removed for servicing a circuit board and reinserted. The pin remains inserted in the presence of mechanical shock and vibration.

It is evident that those skilled in the art may now make numerous uses and modifications of and departures from the specific embodiment described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. In a compliant contact pin for engagement with the inside of a hollow cylindrical surface and having an intermediate portion with first and second end sections relatively slidable along inside edges with the inside edges of a central section the improvement comprising, said end sections being formed with curved outside edges along a length at least of the order of half the outside edge length of each section that is to be adjacent the inside surface of the hollow cylinder to be contacted when inserted, said inside edges of said central and edge sections always being in overlapping relationship over a length less than the length of each inside edge, whereby each of said end sections may rotate about adjacent corners of said central section when seated in said hollow cylindrical surface to enable the end section outside edges to snugly engage the inside surface of said hollow cylindrical surface.

2. The improvement in accordance with claim 1 wherein the radius of curvature of said curved outside edges is of the order of the inside radius of said hollow cylindrical surface.

3. The improvement in accordance with claim 2 wherein said radius of curvature is slightly greater than said inside radius.

4. The improvement in accordance with claims 1, 2 or 3 wherein said outside edge of each end section includes a straight portion joining first and second curved end portions with the length of the second portion being greater than that of the first portion and the first curved portion being nearer to the central section than the second curved portion.

5. The improvement in accordance with claims 1, 2, or 3 and further comprising, means defining said hollow cylindrical surface, said intermediate portion residing in said hollow cylindrical surface with each of said end sections rotated about said adjacent corners of said central section with said end section outside edges snugly engaging the inside surface of said hollow cylindrical surface.

6. The improvement in accordance with claims 1, 2 or 3 wherein the uncompressed overall length of said end and central sections is slightly greater than the diameter of said hollow cylindrical inside surface, and the width of said central section is slightly less than the radius of said hollow cylindrical inside surface and the width of each of said end sections.

* * * * *